United States Patent [19]

Cantor et al.

[11] Patent Number: 4,538,959

[45] Date of Patent: Sep. 3, 1985

[54] CLEAN-IN-PLACE PUMP

[75] Inventors: Frank J. Cantor, Cypress; Robert P. Horwitz, Costa Mesa, both of Calif.

[73] Assignee: International Telephone & Telegraph Corp., New York, N.Y.

[21] Appl. No.: 438,076

[22] Filed: Nov. 1, 1982

[51] Int. Cl.[3] ..... F04D 29/16

[52] U.S. Cl. ..... 415/98; 415/112; 415/169 A; 415/170 B

[58] Field of Search ..... 415/112, 176, 170 B, 415/170 R, 111, 93, 97, 98, 213 A, 121 A

[56] References Cited

U.S. PATENT DOCUMENTS

| | | | |
|---|---|---|---|
| 782,271 | 2/1905 | Ray . | |
| 2,386,898 | 10/1943 | Karassik . | |
| 2,427,656 | 9/1947 | Blom | 415/170 B |
| 2,938,661 | 5/1960 | Ricketts . | |
| 3,171,357 | 3/1965 | Egger | 415/215 X |
| 3,213,798 | 10/1965 | Carswell . | |
| 3,481,273 | 11/1969 | Werra | 415/122 R X |
| 3,632,220 | 1/1972 | Lansinger | 415/112 |
| 3,639,073 | 2/1972 | Beck, Jr. et al. . | |
| 3,801,226 | 4/1974 | Bevan et al. | 415/170 A UX |
| 4,386,780 | 6/1983 | Dernedde | 415/170 B X |

FOREIGN PATENT DOCUMENTS

| | | | |
|---|---|---|---|
| 586433 | 11/1959 | Canada | 415/213 A |
| 2640990 | 4/1973 | Fed. Rep. of Germany . | |
| 3026558 | 1/1982 | Fed. Rep. of Germany | 415/170 B |

*Primary Examiner*—Robert E. Garrett
*Assistant Examiner*—Joseph M. Pitko
*Attorney, Agent, or Firm*—T. L. Peterson; R. C. Turner

[57] ABSTRACT

A clean-in-place pump is disclosed in which the hub of the impeller extends into a pocket in which particles from the fluid being pumped may become entrapped. Axial slots in the drive shaft of the impeller create turbulence within the pocket to dislodge the particles. Back vanes on the impeller and passages through the impeller vane mounting disc cooperate to cause fluid to circulate through the pocket to flush out the particles.

7 Claims, 3 Drawing Figures

CLEAN-IN-PLACE PUMP

BACKGROUND OF THE INVENTION

The present invention relates to a liquid pump and, more particularly, to a clean-in-place pump of the type utilized in sanitary food processing equipment.

Many sanitary food processes require that the equipment being used be cleaned-in-place. That is, a cleaning solution is circulated through the equipment to clean it rather than disassembling the equipment. Electrically driven centrifugal pumps are often used in such equipment. In such a pump there is formed a pocket in the wall of the pump housing, generally where shaft seal is mounted adjacent to the impeller hub, where particles in the fluid being pumped may become entrapped. When a cleaning solution is circulated through such a pump, the particles may not necessarily be flushed out with the result that subsequent food batches introduced into the pump may become contaminated thereby.

United States Patent No. 3,481,273 to Werra dislcoses a sanitary processing centrifugal pump of the above type in which angularly disposed, circumferentially spaced grooves are formed on the drive shaft for the impeller, and on the interior of the hub of the impeller. The grooves cause turbulence which is suposed to flush the hub pocket and adjacent parts as the impeller hub and shaft rotate. It will be appreciated, however, that the forming of angular grooves on the drive shaft for the impeller, and in the interior of the impeller hub is a costly operation.

It is therefore the object of the present invention to provide a clean-in-place pump suitable for use in sanitary food processing equipment in which the hub pocket region may be efficiently flushed out without the requirement of utilizing the angular slots incorporated in the Werra pump.

SUMMARY OF THE INVENTION

According to a principal aspect of the present invention, there is provided a liquid pump in which axial, rather than angular, slots are formed in the drive shaft for the impeller of the pump which communicate with the hub pocket region in which particles may become entrapped. Passages are formed in the impeller vane mounting disc which are in flow communication with the pocket. Back vanes are formed on the impeller which cooperate with the passages to cause circulation of fluid through the pocket to flush out particles which are dislodged from surfaces of the pocket as the result of turbulence created in the pocket by the slots in the drive shaft. Thus, the slots in the drive shaft, the passages and back vanes of the impeller cooperate together to remove foreign material from the hub pocket region of the pump when a cleaning solution is circulated. through the pump.

DESCRIPTION OF THE PREFERRED EMBODIMENT

Figure 1:
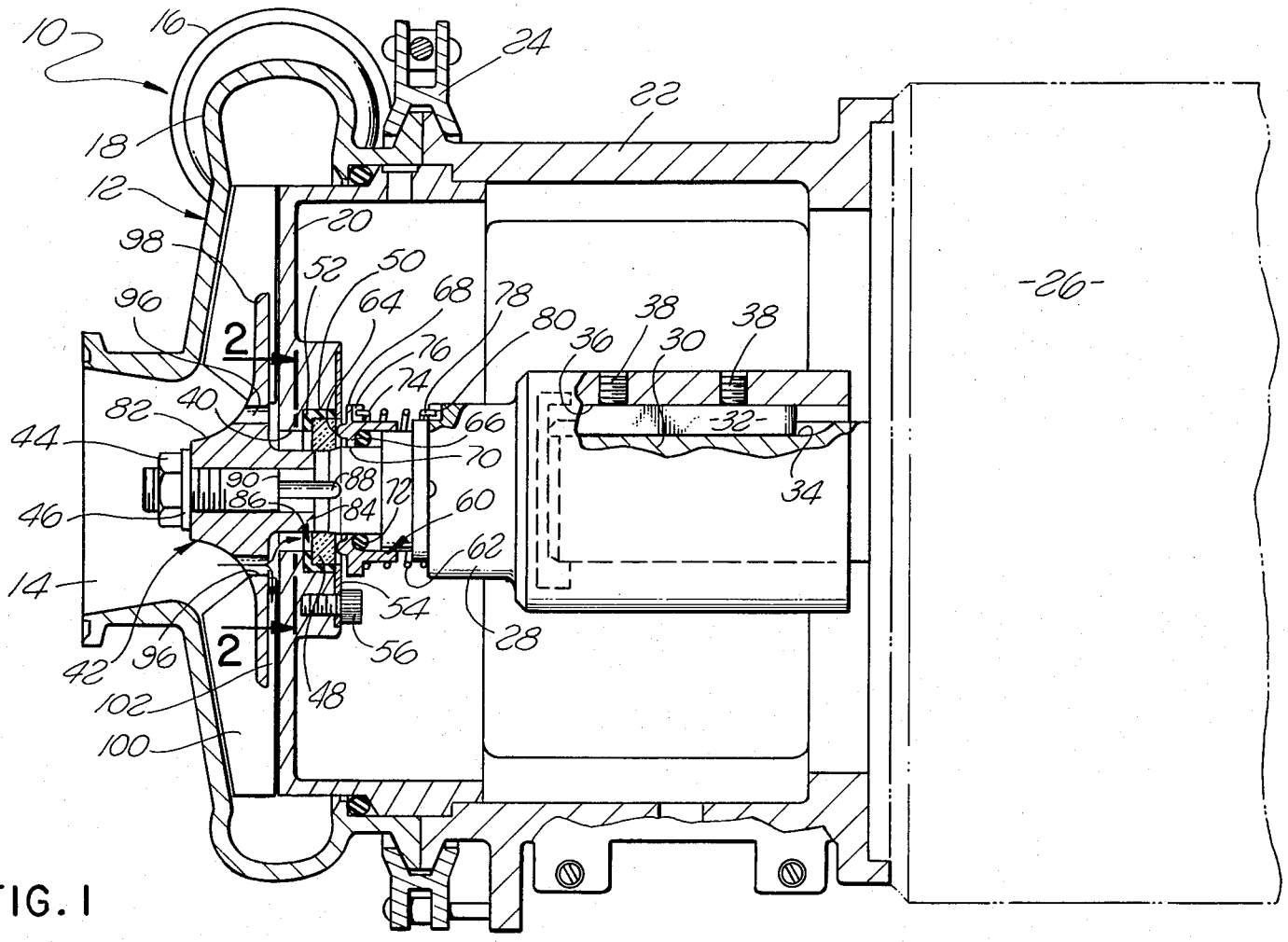
FIG. 1 is a longitudinal sectional view through the pump of the present invention.
Figure 2:
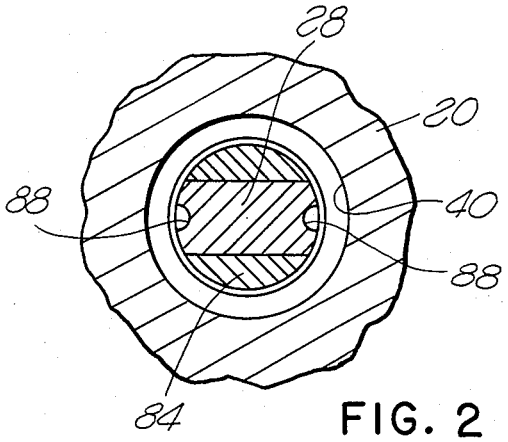
FIG. 2 is a transverse sectional view taken along line 2—2 of FIG. 1 showing the slots in the pump drive shaft.
Figure 3:
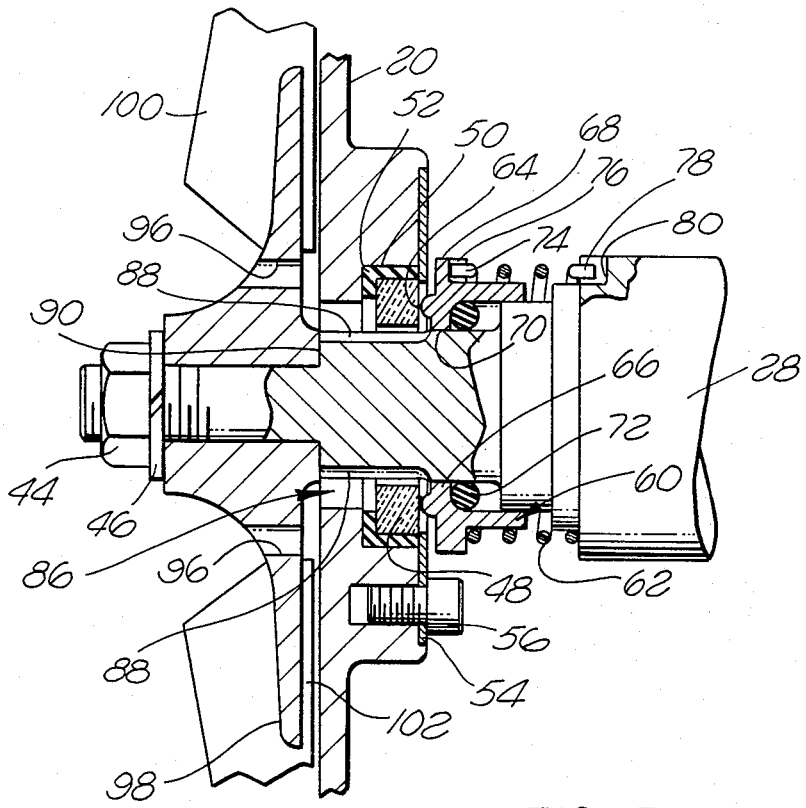
FIG. 3 is an enlarged, fragmentary sectional view showing the drive shaft of the pump rotated 90° from the position illustrated in FIG. 1.

Referring now to the drawings in detail, there is illustrated a centrifugal pump, generally designated 10, of the type which may be utilized in sanitary food processing equipment. The pump comprises a housing 12 having a central inlet 14 and a discharge outlet 16 formed in the volute 18 of the housing. A back plate 20 closes the rear of the housing . The housing and back plate are secured to an adapter ring 22 by a clamping ring 24. The adapter ring is fixed to the housing of a motor 26.

A stub drive shaft 28 is fixed to the shaft 30 of the motor 20 by a key 32 fitted within a keyway 34 in the motor shaft 30 and within a corresponding keyway 36 formed in the inner surface of the stub shaft 28. Set screws 38 retain the key 32 in position.

The forward end of the stub shaft 28 extends through a central bore 40 formed in the back plate 20. The impeller 42 of the pump is retained on the stub shaft by a nut 44 and lock washer 46. A stationary ceramic sealing ring 48 is mounted in a counterbore 50 formed in the rear of the back plate 20. A sealing gasket 52 is positioned between the sealing ring 48 and the wall of the counterbore. The sealing ring 48 and gasket are retained in position in the counterbore 50 by a retainer plate 54 secured against the back of the back plate 20 by screws 56, only one being shown.

A rotatable carbon sealing ring 60 surrounds the stub shaft 28 behind the stationary sealing ring 48. A coil spring 62 biases the sealing ring 60 forwardly so that its forward sealing surface 64 is urged into sealing engagement with the stationary sealing ring 48. The sealing ring 60 is formed with a radially inwardly extending flange portion 66 and an outwardly extending flange portion 68. The inner cylindrical surface 70 of the flange portion 66 is in sealing engagement with the surface of the stub shaft 28. An O-ring 72 is interposed between the sealing ring 60 and the stub shaft behind the flange portion 66. The coil spring 62 is formed with a fowardly extending tab 74 which extends into a noch 76 formed in the rear of the outer flange portion 68 of the rotatable sealing ring, while a tab 78 on the rear of the coil spring extends into a notch 80 in the stub shaft so that the sealing ring 60 will be caused to rotate with the stub shaft.

The hub 82 of the impeller 42 has a rearwardly extending annular portion 84 which extends into the bore 40 in the back plate. The space between the wall of the bore 40 and the outer surface of the rear hub portion 84, the small space between the interior of the stationary sealing ring 48 and the stub shaft, and the space in front of the flange 66 of the rotatable sealing ring 60 underneath the sealing surface 64 form a pocket 86 or dead space in which foreign material may become entrapped because of the lack of fluid flow through this region.

According to the invention, there is provided means for creating turbulence within the pocket 86 and flushing out the particles so that the pump may be cleaned-in-place, thus avoiding the necessity of disassembling the parts of the pump to clean it.

In order to create turbulence in the pocket 86 to dislodge any particles entrapped therein, there is provided a pair of diametrically opposed axially extending slots 88 in the stub shaft 28. The slots extend from a rearwardly facing shoulder 90 on the stub shaft rearwardly to the flange portion 66 of the rotatable sealing ring 60 underneath the sealing surface 64.

In order to flush out the pocket there are provided a plurality of axially extending passages 96 in the region of the impeller vane mounting disc 98 of the impeller just inside the inner edges vanes 100. The passages are preferably equally spaced circumferentially around the impeller hub. By way of example only, five passages 96 may be provided. Also, the impeller vanes 100 extend to the rear side of the disc 98 providing back vane portions 102 adjacent to the back plate 20. The passages 96 and back vane portions 102 cooperate to cause fluid to circulate through the pocket 86 and outwardly in the direction of the arrows shown in FIG. 1 which will effectively clean the pocket. The high velocity fluid flowing through the remainder of the housing 12 will carry the particles out of the pump housing through the discharge outlet 16. Thus, by the present invention the combination of axial slots in the stub drive shaft together with the passages 96 in the impeller disc and the back vane portions 102 cooperate to provide a clean-in-place system for the pump 10.

What is claimed is:

1. A liquid pump comprising:

an impeller mounted for rotation in a housing;

said housing having a wall embodying means forming a pocket in which particles in the fluid being pumped may become entrapped;

a drive shaft extending into said pocket;

said impeller having a hub fixed to said shaft;

an open axial slot formed in said shaft and extending into said pocket forming a flow path for fluid to flow to said pocket for producing turbulence within said pocket;

said impeller embodying a disc extending outwardly from said hub, said disc having a back facing said wall and a front, a plurality of impeller vanes on the front of said disc, a plurality of back vanes on the back of said disc, there being unrestricted flow communication between said impeller vanes and said back vanes;

at least one axial passage extending through said disc and in flow communication with said pocket; and said passage and back vanes cooperating to cause fluid to circulate through said pocket to remove therefrom particles dislodged from the surfaces forming said pocket by the turbulence created by fluid flowing through said slot.

2. A liquid pump as set forth in claim 1 wherein:

said pocket forming means includes a sealing ring surrounding and rotating with said shaft; and said slot extends rearwardly to said sealing ring.

3. A liquid pump as set forth in claim 1 wherein:

a plurality of said slots are formed in said shaft circumferentially spaced from each other.

4. A liquid pump as set forth in claim 1 wherein:

a plurality of said passages are formed in said disc circumferentially spaced around said hub.

5. A liquid pump comprising:

an impeller mounted for rotation in a housing;

said housing having a wall formed with an opening therein, said wall having an outside surface;

a drive shaft extending into said opening from outside said housing;

said impeller having a hub extending into said opening and fixed to said shaft;

a counterbore in the outside surface of said wall;

a first sealing ring fixed in said counterbore surrounding said shaft but spaced therefrom;

a second sealing ring rotatable with said shaft having a forward sealing surface engaging said first sealing ring, and an inner sealing surface engaging said shaft;

the annular space between said first sealing ring and said shaft in front of said second sealing ring being subject to entrapment of particles in the fluid being pumped;

at least one axial slot formed in said shaft extending rearwardly from said hub in flow communication with said annular space for producing turbulence within said space;

said impeller embodying a disc extending outwardly from said hub and carying a plurality of vanes, said disc having a back adjacent to said wall and a front, said vanes extending from said front outwardly from said disc to the back of said disc to provide continuous back vane portions;

at least one axial passage extending through said disc and in flow communication with said annular space; and said passage and back vane portions cooperating to cause fluid to circulate through said annular space to remove therefrom particles dislodged by the turbulence created by said slot.

6. A liquid pump as set forth in claim 5 wherein:

said slot extends behind said forward sealing surface.

7. A liquid pump comprising:

an impeller mounted for rotation in a housing;

said housing having a wall embodying means forming a pocket in which particles in the fluid being pumped may become entrapped;

a drive shaft extending ino said pocket;

said impeller having a hub fixed to said shaft;

an open axial slot formed in said shaft and extending into said pocket forming a flow path for fluid to flow to said pocket for producing turbulence within said pocket;

said impeller embodying a disc extending outwardly from said hub, said disc having a back facing said wall and a front, a plurality of impeller vanes on the front of said disc, a plurality of back vanes on the back of said disc, each said impeller vane being continuous with a corresponding back vane radially outwardly from said disc;

at least one axial passage extending through said disc and in flow communication with said pocket; and said passage and back vanes cooperating to cause fluid to circulate through said pocket to remove therefrom particles dislodged from the surfaces forming said pocket by the turbulence created by fluid flowing through said slot.

* * * * *